United States Patent [19]

Borup

[11] 4,023,394

[45] May 17, 1977

[54] VEHICLE ALIGNMENT APPARATUS

[75] Inventor: Jörgen Borup, Vaxjo, Sweden

[73] Assignee: AB Nike Hydraulik, Eskilstuna, Sweden

[22] Filed: Feb. 19, 1975

[21] Appl. No.: 551,193

[30] Foreign Application Priority Data

Feb. 20, 1974 Sweden ..... 74022526

[52] U.S. Cl. ..... 72/457; 72/705; 269/321 W

[51] Int. Cl.[2] ..... B21D 1/12

[58] Field of Search ..... 72/705, 457; 269/81, 269/156, 321 W

[56] References Cited

UNITED STATES PATENTS

| | | | |
|---|---|---|---|
| 2,140,686 | 12/1938 | Bennett | 72/705 |
| 2,151,063 | 3/1939 | Weaver | 72/705 |
| 2,445,397 | 7/1948 | Horton | 72/705 |
| 2,542,836 | 2/1951 | Porter et al. | 72/705 |
| 2,559,250 | 7/1951 | Jackson | 72/705 |
| 2,563,527 | 8/1951 | Gingrich et al. | 72/705 |
| 2,646,101 | 7/1953 | Fergurson | 72/705 |
| 2,705,040 | 3/1955 | Howick | 72/705 X |
| 2,830,789 | 4/1958 | MacMillan | 72/705 |
| 3,034,563 | 5/1962 | Gaspar et al. | 72/705 X |
| 3,626,747 | 12/1971 | Rouis | 72/705 |
| 3,818,579 | 6/1974 | Pietrelli | 72/705 X |

FOREIGN PATENTS OR APPLICATIONS

| | | | |
|---|---|---|---|
| 2,145,992 | 9/1971 | Germany | 72/705 |
| 338,753 | 1971 | Sweden | 72/705 |

*Primary Examiner*—Victor A. DiPalma
*Assistant Examiner*—D. M. Gurley
*Attorney, Agent, or Firm*—Pollock, Vande Sande & Priddy

[57] ABSTRACT

Method and apparatus for the repair of damaged vehicle body structure of the type in which the apparatus is secured to the vehicle body or frame and supports force-applying apparatus and measuring apparatus to permit concurrently the repair of damaged parts and the making of measurements relative to selected datum points. The apparatus comprises a pair of beam members each of which movably supports thereon a pair of clamping means for clamping to the underside of the vehicle body so as to permit these two beam members to be clamped in horizontal parallel spaced relationship to each other transversely to the vehicle's longitudinal axis. A means such as a pair of supporting wheels affixed to each of the transverse beams holds the beams and the attached vehicle in an elevated position to permit the insertion under the transverse beams of a rigid rectangular frame whose length at least equals that of the vehicle body and whose width is less than the length of each transverse beam. Clamping through bolts pass through both a transverse beam and the longitudinal beam members forming the rigid frame to provide a rigid structure which supports force-applying apparatus and measuring apparatus.

10 Claims, 12 Drawing Figures

FIG. 1
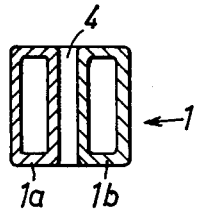
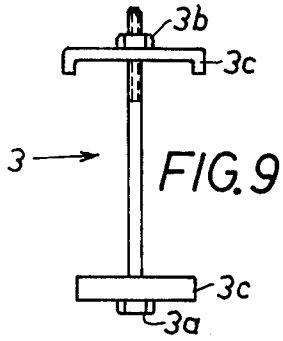
FIG. 9
FIG. 2
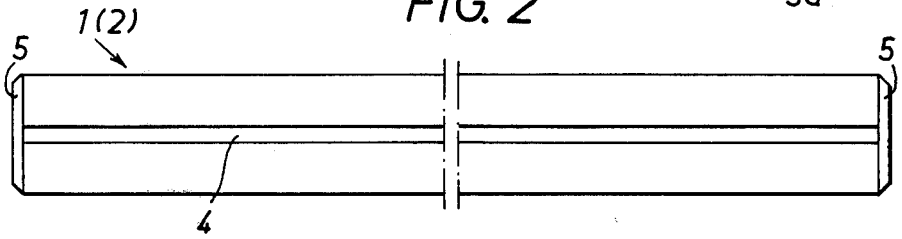
FIG. 5
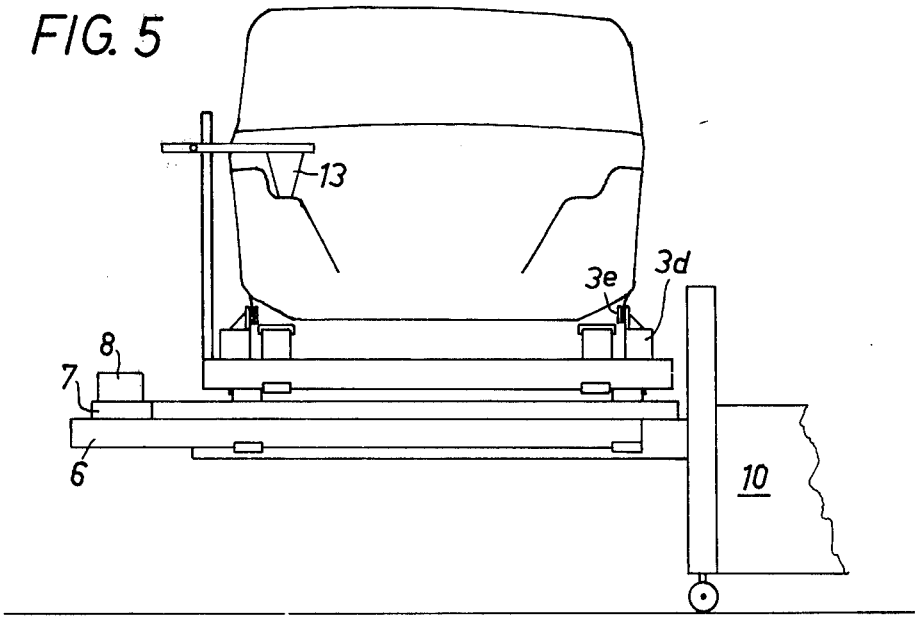

VEHICLE ALIGNMENT APPARATUS

BACKGROUND OF THE INVENTION

The present invention relates to an apparatus for alignment of vehicle bodies and frames and comprising a rectangular beam frame having attachment means for rigidly supporting the vehicle while carrying out alignment operations, which frame also serves as the basis for securing various alignment devices required for said alignment operations, said frame including at least two beam members extending longitudinally of the vehicle to be aligned and at least two crossing transverse beam members, which are placed in superposed relationship at the crossing points preferably with the transverse beam members uppermost and joined by securing means located in vertical longitudinal slots in said beam members so as to be variably adjustable along the length thereof.

Vehicle frame alignment apparatus of this kind have been known for several decades and have generally comprised a rigid frame of steel beams. Mainly said frame also has been stationary, either sunk into a moulded floor or other ground or supported from a ground by a base, such as in the form of a center pillar. In its turn, the vehicle has been mounted on said frame by securing means, and on the frame also has been mounted the alignment apparatus, mostly of hydraulic type, which are required for carrying out the alignment operations.

Originally, the securing means for securing the vehicle to the frame consisted of simple posts or trestles bolted directly to the chassis frames of the vehicles at that time. In the alignment of modern vehicle bodies of self-supporting type it became, however, more and more difficult to obtain such load-carrying points on the vehicle body which could be utilized for the attachment of the vehicle on the alignment frame during the alignment operation. This implied a restriction to the use mostly of the details of the vehicle body which are particularly reinforced and which have great load-carrying capacity, such as the front wheel suspension mountings, the rear wheel spring mountings and the like. In its turn, this has required that every car manufacturer has been forced to state for each model and particular car type a number of such points or locations in the vehicle which are suited for such attachment purposes. In connection therewith, it is also necessary that the car manufacturer mentions suitable points in the body, particularly on the underside of the bottom plate from which measurements can be made for the determination of the deformations of the body, if any, and thus also for ensuring that the vehicle, after alignment, has regained its original shape corresponding to the drawings of the manufacturer, so as to fulfill all traffic safety requirements.

As a consequence, the manufacturer of alignment apparatus also must manufacture and market a particular set of securing means or fixtures for each car make, type and model so as to allow the use of the alignment apparatus for aligning said vehicles. In many cases, it has also been necessary to manufacture individually for each vehicle make, type and model particular checking fixtures for measuring the extent of the damage to the vehicle and the required alignment and checking thereof when finished. The costs for each such set of fixtures etc. is relatively great and can amount to $900–$1200. However, the economically profitable period for carrying out more extensive alignment operations on modern vehicles is only about 3–5 years and not even the largest alignment work shops have the opportunity to carry out more than a restricted number of such operations on each individual vehicle type and model, and thus it is obvious that the procuring of all these sets of fixtures for each model of each vehicle make and type is a very heavy investment in view of the short useful period.

Certainly, said prior alignment apparatus of permanent and stationary type could be used for most, but not all, types of body damage; nevertheless, certain very heavily wrought bodies could not be attached and aligned in a satisfactory manner. Also such apparatus is voluminous and cumbersome to use and therefore not so well suited to modern, highly rationalized and mechanized and piece-rated operations in modern auto repair shops. Therefore, there has been a tendency for several years to modernize and improve the prior alignment apparatus by means of a number of various provisions. Thus, the beam frame has been made separate from its permanent mounting and instead been made movable on rollers on the floor so as to be able to be moved at will. For the attachment of the vehicle bodies to the beam frame, attempts had been made to eliminate the expensive individual fixtures for each vehicle model and to utilize instead more universally adaptable securing means of clamping jaw type, which are attached to the weld rim along the sides of the vehicle, i.e. the so-called door sills. Said portions of the vehicle bodies now have increased strength, because of the need to provide torsional stiffness and load-carrying capability of the body and therefore they can be advantageously utilized for attachment purposes. Many times, however, the locations for said attachment are more or less heavily damaged and therefore it is still difficult to utilize said securing means.

Moreover, the beam frame has been provided with attachment points for support beams for supporting drawing alignment devices in the form of hydraulic or pneumatic pressure cylinders or the like. Said support beams have been mounted by means of clamping connections or bolts passed through uniformly spaced holes in the flanges of the beams or the like.

Another difficulty in connection with prior alignment apparatus has been the checking of the measures of the vehicle both before the alignment operation for determining the extent of the deformations of the vehicle and after an alignment operation to determine that the alignment has been correctly made. When particular checking fixtures were to be avoided for such measuring, mainly only two other measuring methods have been available, namely either a projection of the reference points of the vehicle to the floor by means of a plummet or measuring by means of adjustable measuring rods, i.e. so-called telescopes. A measuring of the whole underframe of the car by means of such telescopes is very cumbersome and thus expensive, while a plummet measuring in spite of greatest carefulness still turns out to be afflicted with substantial errors. To obtain a very high degree of precision in measurement, a special measuring apparatus must be used, but this requires of course a cumbersome moving of the work between measuring apparatus and alignment apparatus several times. Recently, optical measuring devices have been developed, particularly of the laser kind, which have made it highly desirable to carry out the control measurement directly on the alignment apparatus, especially in connection with the carrying-out of the very alignment operations. This cannot be done, however, on the prior alignment apparatus due to its structural design and the method for its use. Particularly, it has been especially difficult to measure exactly the vertical deformations of the vehicle since no measuring devices suitable for this purpose have existed.

SUMMARY OF THE INVENTION

Thus, there is a very great demand within the vehicle alignment field to provide a significantly improved alignment apparatus which can fulfill in a much more effective way the requirements demanded by modern auto repair shops. The main object the present invention therefore is to provide such an alignment apparatus and the invention is based on the idea that with an alignment apparatus of improved structure and design, the most advanced requirements of today can be filled.

This object is achieved by means of an alignment apparatus distinguished in that said beam members each consist of two parallel closed box girders of rectangular upright cross-section and spaced sufficiently to form a slot by means of spacer plates secured to the ends of the beams, and in that the securing means consist of easily releaseable connecting members in the form of a bolt extending through the slots and having a nut and a pair of washers which clamp somewhat over the outer surfaces of the respective beam members so as to prevent an undesirable resilient spreading apart of said box girders while loaded.

The invention provides an alignment apparatus which can be mounted simply and very quickly under a vehicle to be aligned instead of requiring that the vehicle be moved onto to the apparatus, but which nevertheless has such a rigidity and versatility in its possible uses that not only all possible alignment operations can be made without difficulty but also all required control measurements which for the rest can be carried out concurrently with the alignment work.

BRIEF DESCRIPTION OF THE DRAWINGS

By way of example, the invention will be further described below with reference to the accompanying drawings, in which:

FIG. 1 is a cross-section of a beam member according to the invention;

FIG. 2 is a plan view of the beam member of FIG. 1;

FIG. 5 is an end view of the apparatus according to the invention;

FIG. 9 is a side view of a connecting member.

DETAILED DESCRIPTION OF THE PREFERRED EMBODIMENTS

Figure 3:
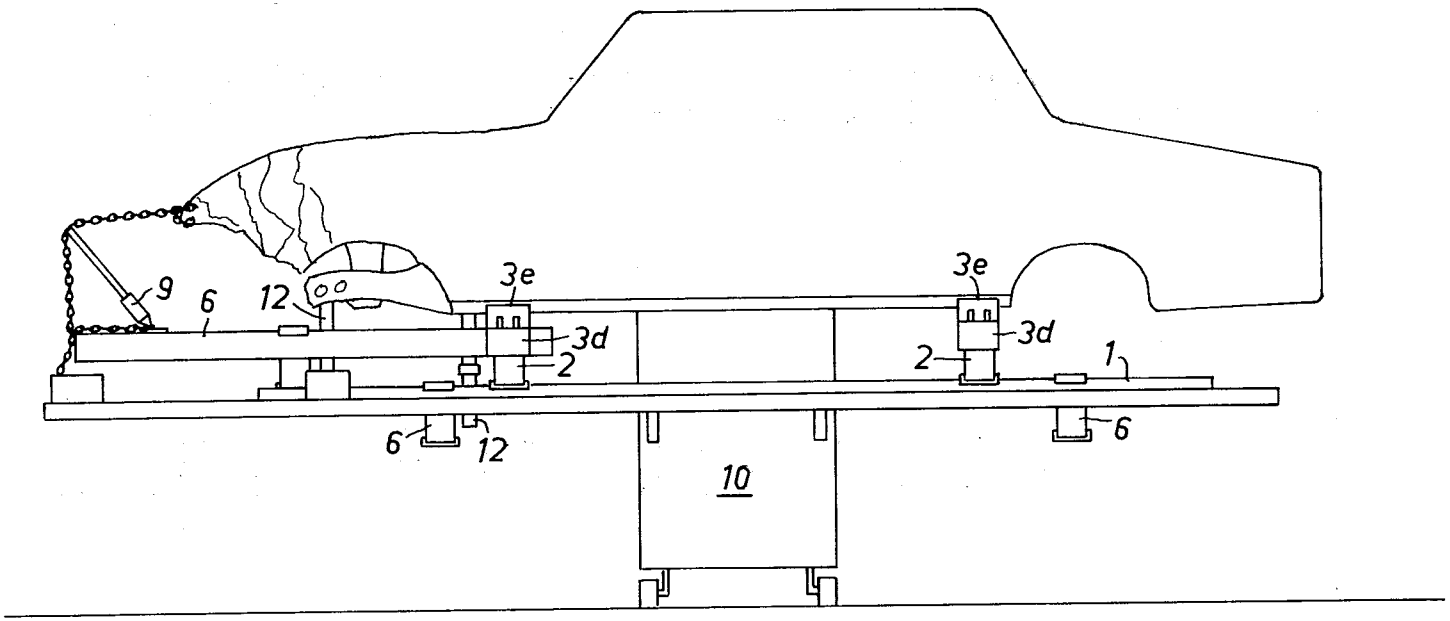
FIG. 3 is a diagrammatical side elevational view of an alignment apparatus according to the invention with a vehicle to be aligned by means of attached alignment devices being mounted thereon, said alignment apparatus being elevated from the floor by means of a fork-lift device.

With reference to the drawings and particularly FIGS. 1 and 2 thereof, the alignment apparatus is based on the idea that the beam frame is assembled of individual parts, namely at least two beam members 1, extending longitudinally of the vehicle to be aligned, and at least two crossing transverse beam members 2. In order to form a rectangular frame of required rigidity, said beam members are adapted to be superposed at the crossings, preferably with the transverse beam members 2 uppermost, and fixed in desired position by means of an easily releasable and tightenable connecting means 3. Although said connecting means can be made in many different ways, it is preferred that the same extends through the very beam members and in such case it may comprise a bolt 3*a* with a nut 3*b* and a pair of washers 3*c*. Also, the beam members may be made in a number of different ways and, for co-operation with such penetrating connecting members 3 of the last-mentioned type, they can be provided with a plurality of central penetrating openings along the lengths of the beam members or still better one single and penetrating slot 4, such as illustrated in FIG. 2. In this way, it is possible to provide completely variable adjustment of the positions of the crossing points between the beam members. Since it is of greatest importance for the good function of the beam frame that the individual beam members be rigid against deformation, the beam members must have a design and cross-section suitable for this purpose, and it has been found to be particularly advantageous for each beam member to comprise two parallel closed box girders of rectangular upright cross-section (1*a*, 1*b* of FIG. 1). Said box girders are disposed with a mutual spacing corresponding to the width of the desired slot 4 by means of spacer plates 5 secured to the ends of the beam members. A particularly advantageous embodiment of the beam members can be obtained by choosing the height of the box girders equal to twice the width plus the width of the slot 4, so that the beam members thus have a square cross-sectional shape.

When beam members 1, 2 are used, which have such a continuous penetrating vertical slot 4, it is desirable that each of the washers 3*c* of the connecting members 3 at their opposite sides are angularly bent so that they can grip somewhat over the outer sides of the beam members and thus prevent an undesirable resilient spreading apart of the box girders while loaded.

To connect the beam frame with the vehicle, clamping means are mostly to be utilized engaging protruding welding seams or rims on the vehicle underframe in the same way as mentioned above. It is suitable to utilize attachment means which are made similar to the connecting members 3 but in which one of the washers, the upper one is made as a mounting 3*d* for a pair of clamping jaws 3*e* or similar attachment devices.

For carrying out the required alignment operations on a vehicle attached to a beam frame thus assembled of four beam members 1, 2 various kinds of alignment devices are required, preferably drawing rams 9. To allow the connection of such rams with the beam frame, supporting beam members 6 are used according to the invention, which also preferably are provided with a slot 4 similar to the beam members 1 and 2 and preferably also correspond to beams 1 and 2 with respect to their structure and cross-sectional shape. Of course, the length of the supporting beam members 6 can be different from the length of the other beam members 1 and 2, but from a manufacturing point of view it is advantageous if the number of beam member lengths in connection with the alignment apparatus according to the invention is restricted to a low number, such as three or four.

With said different beam member lengths, the required beam frame can be assembled and provided with as many drawing rams and other facilities as required for carrying out the operation. Owing to the fact that the supporting beam members 6 have the same shape and structure for the rest as the beam members 1 and 2, the supporting beam members easily can be mounted above or below the other beam members at any selected position over the whole frame and in any angular position. Because of this, a flexibility of the apparatus according to the invention is obtained which has been completely impossible to achieve with any other previously known alignment apparatus structure. Of course, said supporting beam members preferably are to be mounted to the other beam members by means of similar connecting members 3 as used in connection therewith. It is also possible to mount and locate two or more such supporting beam members 6 protruding beyond the sides of the vehicle so that a measuring ruler 7 and other measuring facilities can be carried thereby, such as in connection with optical chassis measurements, e.g. by means of a laser device 8.

The beam frame thus assembled by the beam members 1 and 2 and adapted for rigidly securing the vehicle while alignment operations are made thereon thus is independent of the ground and can be supported in any suitable way. Thus, the frame with the vehicle can be kept temporarily or permanently raised to a suitable height from the ground by means of any kind of lifting device, such as a fork-lift device 10, as illustrated in FIG. 5. If this fork-lift device is self-tractioned, an advantage also is obtained in that the beam frame easily can be moved to various locations in a work shop and parked on trestles or the like or directly on the floor when an interruption is to be made in the work or other provisions are to be made. This provides a most essential advantage over previously known structures.

The beam frame also becomes much easier to adapt to the actual kind of damages on the vehicle body to be aligned, since the location of the beam members 1 and 2 in the longitudinal and transversal direction of the vehicle easily can be selected so as to best suit the available attachment locations on the underframe of the vehicle dependent on the actual damages. Because of this, there can be mounted on the beam frame vehicle bodies which are very heavily curved in lateral directions. Due to the shape and location of the beams and the attachment thereof to the vehicle along welding rims at the sides thereof, also all the points on the underframe are exposed which the vehicle manufacturers specify as reference points for the control measurements of the vehicle. In making optical measurements and particularly when measuring with a laser device, mountings for measuring rulers of various kinds can be attached to said points, often vertically depending rulers 12 such as illustrated in FIG. 3.

Another essential advantage of the alignment apparatus according to the invention is that by means of simple and universally usable supporting means detachably affixed to the beam frame, measuring gauges 13 easily can be mounted at locations on the vehicle prescribed by the manufacturers for making various vertical measurements under the intermediation of, for example, measuring rulers adapted for optical measurements, such as illustrated in FIG. 5. A check of the reference points of the vehicle also vertically now can be made in a much more precise way than hitherto which allows an essentially increased exactness in the alignment operations made.

Figure 4:
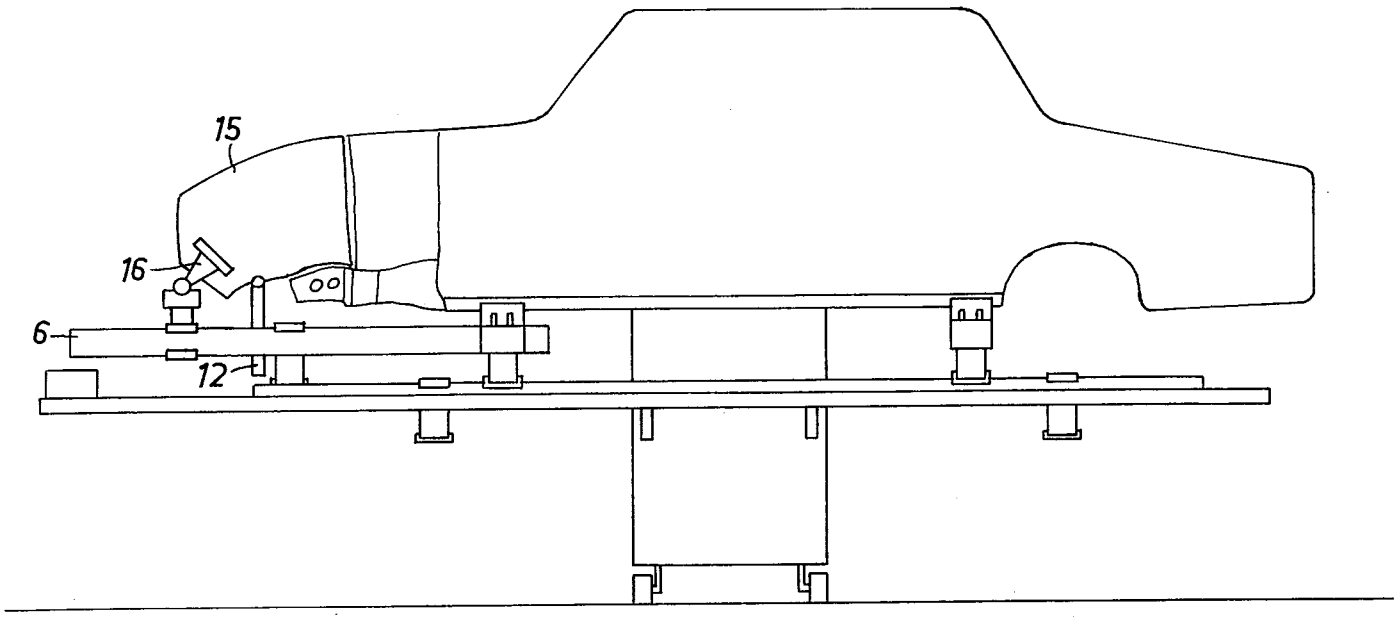
FIG. 4 is side elevational view of apparatus similar to FIG. 3 but with a vehicle mounted on the apparatus, on which collision-damaged portions are to be replaced and the apparatus thus is to be used as welding fixture.

Still another advantage of the alignment apparatus according to the invention is that similarly by means of simple and universally usable supporting means detachably affixed to the beam frame, there can be supported, aligned and secured substitute sheet metal parts which are to be secured to a damaged vehicle by welding or the like. Thus, the alignment apparatus simultaneously can serve as welding fixture even during a simultaneous alignment control by means of, for example, the optical measurement facilities. This is illustrated in detail in FIG. 4 of the drawings, in which a substitute sheet metal part 15 is supported by means of a supporting member 16, made as a ball joint and secured to a supporting beam member 6. If it is possible to find a reference point on or adjacent to such a substitute part, a measuring means, such as a measuring ruler 12 may then be secured, and then the optical measurement facilities can be utilized to locate the substitute part 15 carried by the supporting means 16 in its exact intended position before welding it or otherwise rigidly securing it at its location in the vehicle. By this means, greater precision is obtained when joining sheet metal parts of various sizes on damaged vehicle bodies than was heretofore possible. Even vehicle body halves can be joined both in longitudinal and transversal direction with required precision.

In the application of the alignment apparatus according to the invention in practice, first the transversal beam members 2 with the securing means 3*d*, 3*e* mounted thereon are mounted at desired locations in sheet metal rims on the undersurface of the vehicle at its front and rear portions, respectively, as illustrated in FIG. 3. If the vehicle is heavily damaged, it can be temporarily raised at its front and/or rear end by means of a conventional jack. After this, the longitudinal beam members 1 are mounted with a suitable mutual spacing to the underside of the transverse beam members 2. Then the beam frame thus formed suitably is lifted by means of the intended lifting device 10, after which one or more supporting beam members 6 are mounted in desired locations and angular directions for allowing the mounting of the drawing ram 9.

Figure 6:
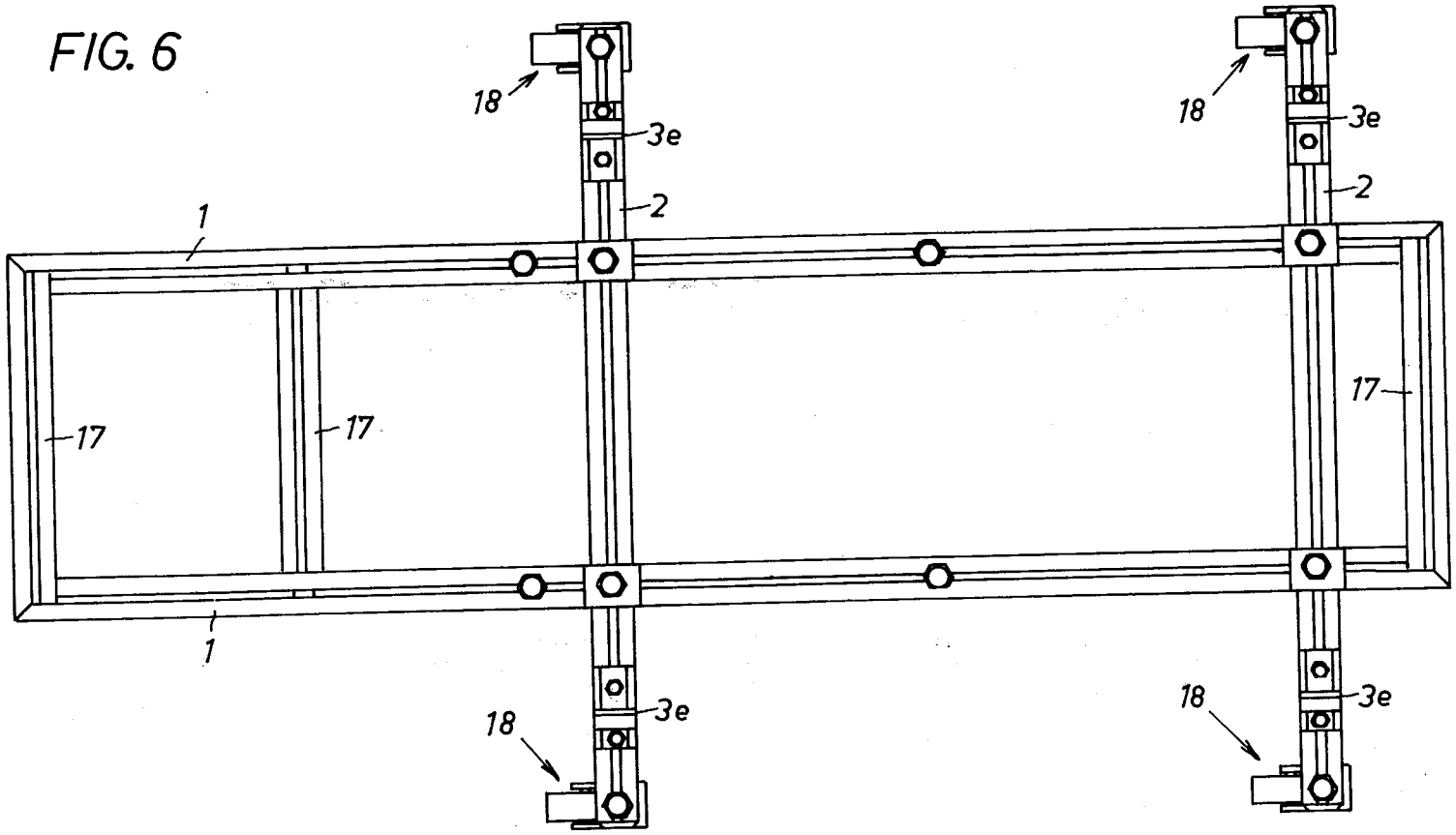
FIG. 6 is a plan view of a finished beam frame of the apparatus according to the invention.
Figure 7A:
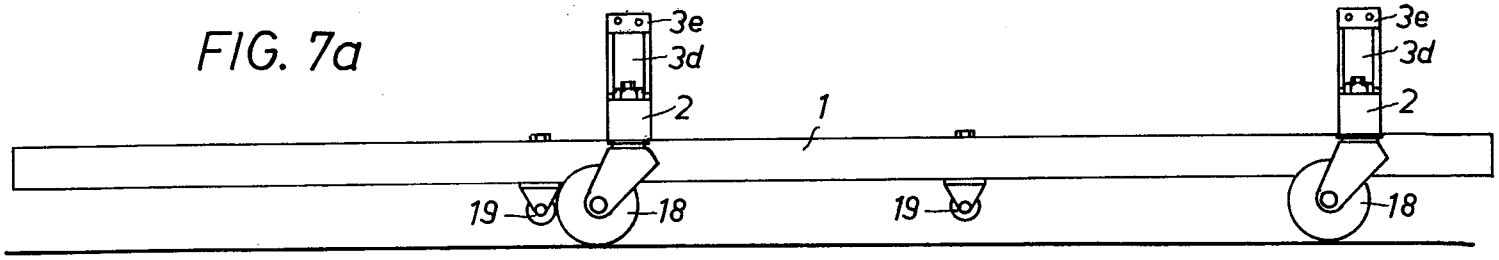
FIGS. 7*a* and 7*b* comprise a side elevational view and an end view, respectively, of another embodiment of the invention.
Figure 7B:
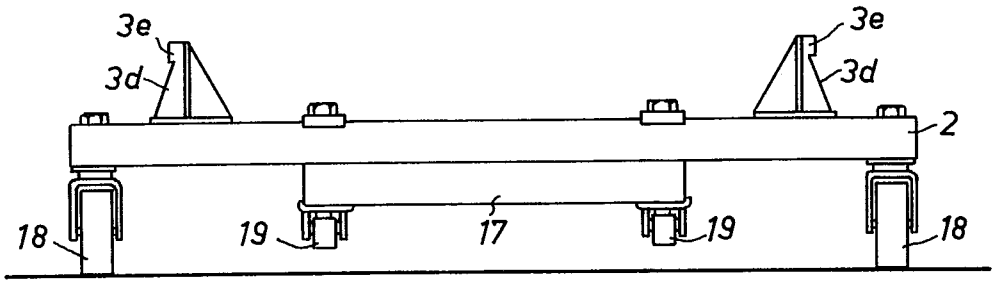

A further embodiment of the invention is disclosed in FIGS. 6–8. In said embodiment, it has been found, namely, that from a practical view point it is advantageous to permanently interconnect at their ends the two longitudinal beam members 1 by means of connecting beam members 17 (FIG. 6). Preferably, said connecting beam members 17 also are provided with slots similar to the other beam members and suitably a further permanently mounted connecting beam member 17 is located adjacent one end of the basic beam frame so as to serve as support for one or more support beam members 6, which mostly are to be mounted protruding from one end of the beam frame.

Figure 8A:
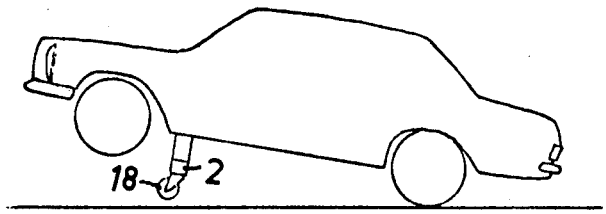
FIGS. 8*a–c* illustrate the attachment of an alignment apparatus according to the embodiment illustrated in FIGS. 7*a* and 7*b* below a vehicle which is to be aligned.
Figure 8B:
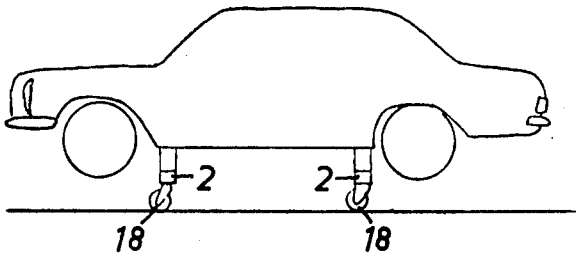
Figure 8C:
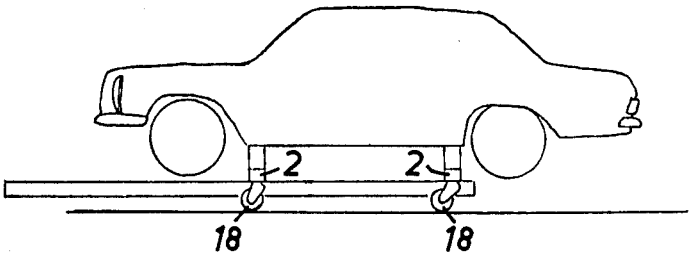

It has also been found advantageous to provide the transverse beam members 2 with easily attachable and detachable castor wheels 18 at the ends so that the vehicle can be supported on said relatively great castor wheels 18 when lowering the jack, as shown in FIGS. 8*a–c*.

These castor wheels 18 preferably are of such a diameter that the transverse beam members 2 will be located at a sufficient height above the ground or floor to allow the basic beam frame comprising members 1, 17 to be freely inserted below said transverse beam members.

In this connection, the basic beam frame comprising members 1, 17 preferably is provided with support rollers 19 to facilitate the insertion of the basic beam frame under the vehicle. After securing the basic beam frame rigidly to the transverse beam members 2 as stated above by means of connecting members 3 at the crossing points, the alignment apparatus with the vehicle mounted thereon can be easily moved by hand over the floor for being transferred to another suitable location. This latter feature is, of course, advantageous.

With the present invention is provided for the first time an alignment apparatus which is not fixed in position so that the damaged vehicle must be moved to the apparatus; instead, the alignment apparatus can be assembled under the damaged vehicle at the place where the same is standing while taking into consideration

I claim:

1. Apparatus for the repair of damaged vehicle body structure which apparatus is adapted for securing to the vehicle body or frame and supports force-applying apparatus and also supports measuring apparatus to permit concurrently the repair of damaged parts and the making of measurements relative to selected datum points, and being further adapted to render the damaged vehicle movable, said apparatus comprising:

vehicle support means including detachably connectable first frame means and second frame means, said first frame means including a plurality of first beams and a plurality of clamping means for clamping said first beams to a part of the vehicle body or frame in horizontal parallel spaced relationship to each other transversely of the vehicle's longitudinal axis when said vehicle is raised at least at one end thereof above a supporting surface such as a floor, first roller means comprising rollers at spaced locations along each of said first beams for supporting said first beams at a first predetermined height above the supporting surface, second frame means including a pair of spaced parallel longitudinal beams each having a length at least equal to that of the vehicle body, second roller means at spaced locations along said second frame means for supporting said second frame means at a second predetermined height above said supporting surface which is so related to said first predetermined height as to permit the rolling insertion of said second frame means under said first frame means when said vehicle and first frame means are lowered to said supporting surface while said first frame means supports thereon a vehicle body, said rollers of said first frame means being sufficiently spaced along said first beams to avoid interference with said second frame means at the time of its insertion under said first frame means, means for detachably securing said first frame means to said second frame means at each point of intersection of each said first beam with each said longitudinal beam, and force applying means detachably supported on said vehicle support means for application of a force to a structural part of the vehicle for restoring said part to its original configuration.

2. The apparatus of claim 1 wherein said second frame means further includes a plurality of transverse members interconnecting said parallel longitudinal beams to form a rigid generally rectangular frame.

3. The apparatus of claim 1 wherein said first roller means comprises wheels mounted adjacent each end of each said first beam.

4. The apparatus of claim 1 which further includes measuring apparatus mounted on said vehicle support means.

5. The apparatus of claim 1 wherein each said first beam defines at least one uninterrupted vertical slot therein, said securing means passing through said slot and fastening also to one of said longitudinal beams.

6. The apparatus of claim 5 wherein each said longitudinal beam defines therein at least one uninterrupted vertical slot, and securing means passing through the intersecting slots in respectively said first beam and each longitudinal beam at their points of intersection.

7. The apparatus of claim 6 wherein said securing means includes a through bolt passing through the aligned intersecting slots of the intersecting first and longitudinal beams, said bolt on each end supporting washer means of generally rectangular configuration and extending at least to the edge of the relevant beam.

8. The apparatus of claim 1 wherein at least one further supporting beam is movably secured to said vehicle support means, and measuring means is mounted on said supporting beam.

9. The apparatus of claim 8 wherein said measuring means includes a laser measuring device.

10. The apparatus of claim 1 which further includes a supporting beam movably secured to said vehicle support means, and force applying means connected to said supporting beam.

* * * * *